US010898046B2

(12) United States Patent
Shim et al.

(10) Patent No.: US 10,898,046 B2
(45) Date of Patent: Jan. 26, 2021

(54) AGITATOR AND ROBOT CLEANER INCLUDING THE SAME

(71) Applicant: LG ELECTRONICS INC., Seoul (KR)

(72) Inventors: Inbo Shim, Seoul (KR); Yonggil Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 379 days.

(21) Appl. No.: 15/914,367

(22) Filed: Mar. 7, 2018

(65) Prior Publication Data

US 2018/0192844 A1 Jul. 12, 2018

Related U.S. Application Data

(63) Continuation of application No. 14/994,769, filed on Jan. 13, 2016, now Pat. No. 10,092,153.

(30) Foreign Application Priority Data

Mar. 24, 2015 (KR) ..... 10-2015-0040854

(51) Int. Cl.

| | |
|---|---|
| ***A47L 9/04*** | (2006.01) |
| ***A46B 9/02*** | (2006.01) |
| ***A46B 13/00*** | (2006.01) |
| ***A47L 11/24*** | (2006.01) |

(52) U.S. Cl.

CPC ..... *A47L 11/24* (2013.01); *A46B 9/028* (2013.01); *A46B 13/001* (2013.01); *A47L 9/0466* (2013.01); *A47L 9/0477* (2013.01); *A47L 2201/00* (2013.01)

(58) Field of Classification Search

CPC ..... A47L 11/24; A47L 9/0477; A47L 9/0466; A47L 2201/00; A47L 9/28; A46B 9/028

See application file for complete search history.

(56) References Cited

U.S. PATENT DOCUMENTS

| | | | |
|---|---|---|---|
| 2,411,488 | A | 11/1946 | White |
| 2,734,211 | A | 2/1956 | Vance |
| 2,754,531 | A | 7/1956 | Rowland |
| 5,134,744 | A | 8/1992 | Ji |
| 7,171,723 | B2 | 2/2007 | Kobayashi et al. |

(Continued)

FOREIGN PATENT DOCUMENTS

| | | |
|---|---|---|
| JP | 2001-120472 | 5/2001 |
| JP | 2004-222739 | 8/2004 |

(Continued)

OTHER PUBLICATIONS

AU Search Report dated May 11, 2016 issued in Application No. 2015255232.

(Continued)

*Primary Examiner* — David Redding

(74) *Attorney, Agent, or Firm* — KED & Associates, LLP

(57) ABSTRACT

An agitator and a robot cleaner including an agitator. The agitator includes a body configured to be rotated, a plurality of couplers formed at the body and arranged to be spaced apart from each other by a predetermined distance, and a first member and a second member coupled to any one of the couplers and configured to contact a surface to be cleaned during rotation of the body. The first member and the second member extend different lengths from the body in a radial direction.

19 Claims, 5 Drawing Sheets

(56) References Cited

U.S. PATENT DOCUMENTS

| | | | |
|---|---|---|---|
| 9,763,549 | B2 | 9/2017 | Hyun et al. |
| 2005/0039282 | A1 | 2/2005 | Paterson et al. |
| 2014/0259475 | A1 | 9/2014 | Doughty |
| 2015/0342430 | A1 | 12/2015 | Kasper et al. |

FOREIGN PATENT DOCUMENTS

| | | |
|---|---|---|
| JP | 2004-261539 | 9/2004 |
| JP | 5161689 | 3/2013 |
| KR | 10-0382237 | 4/2003 |
| KR | 10-2010-0088360 | 8/2010 |
| KR | 10-1413259 | 7/2014 |
| WO | WO 2014/091116 | 6/2014 |

OTHER PUBLICATIONS

Au Office Action dated Oct. 8, 2016 issued in Application No. 2015255232.

U.S. Office Action dated Dec. 27, 2017 issued in co-pending U.S. Appl. No. 14/994,769.

AU Office Action dated Feb. 7, 2018 issued in Application No. 2016244233.

AGITATOR AND ROBOT CLEANER INCLUDING THE SAME

CROSS-REFERENCE TO RELATED APPLICATION

This application is a Continuation Application of prior U.S. patent application Ser. No. 14/994,769 filed Jan. 13, 2016, which claims priority under 35 U.S.C. § 119 to Korean Patent Application No. 10-2015-0040854, filed on Mar. 24, 2015, whose entire disclosures are hereby incorporated by reference.

BACKGROUND

Field

The present disclosure relates to an agitator and a robot cleaner including the same.

Background

In general, robots have been developed for industrial use, and have been responsible for automating portions of factories. As robots have recently been applied to various fields, medical robots, aerospace robots, home robots, etc. are being developed.

A representative of home robots is a robot cleaner, a kind of home electronic appliance capable of performing a cleaning operation by sucking dirt, such as dust, hair, etc., while autonomously travelling in a predetermined region. Such a robot cleaner is typically provided with a chargeable battery and an obstacle sensor to avoid obstacles while travelling, thereby autonomously travelling and cleaning the floor.

The robot cleaner further includes a main body defining its external appearance and having a suction port for sucking dirt such as dust, wheels provided at the main body, a driving motor for driving the wheels, a dust collector for collecting dirt such as dust, and a suction motor connected with the dust collector. The robot cleaner is used to perform a cleaning operation in various environments, such as carpet, floors, etc., while autonomously travelling within the region to be cleaned. However, because a user cannot replace the agitator whenever he or she wants to clean different regions, uniform cleaning performance for different regions has not been achieved.

BRIEF DESCRIPTION OF THE DRAWINGS

The embodiments will be described in detail with reference to the following drawings in which like reference numerals refer to like elements wherein.

DETAILED DESCRIPTION

Figure 1:
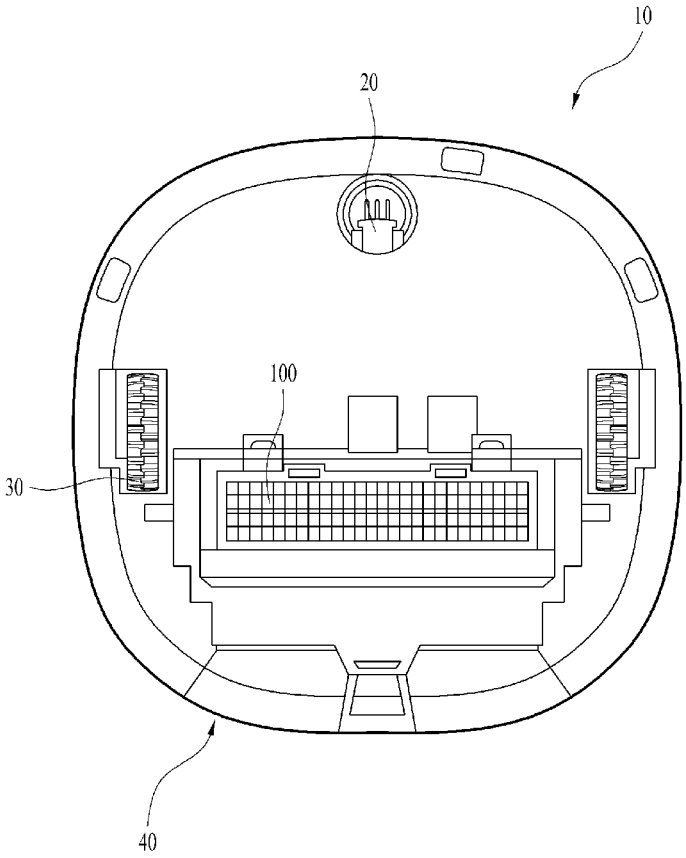
FIG. 1 is a view illustrating the bottom surface of a robot cleaner according to an embodiment.

FIG. 1 is a view illustrating the bottom surface of a robot cleaner according to an embodiment. The robot cleaner includes a main body 10 defining an exterior appearance thereof, main wheels 30 provided at the main body 10 and configured to roll so as to move the main body 10 forward and backward or rotate the main body 10, and a front auxiliary wheel 20 for supporting a portion of the main body 10 and assisting the rotation of the main body 10 by the main wheels 30.

The main wheels 30 are provided separately on the left side and the right side of the main body 10, and the left wheel and the right wheel may be driven independently of each other. In an example, the main wheels 30 may be separately driven by different motors. The main body 10 is provided with an agitator 100, which is configured to sweep or strike dirt or the like. The two main wheels 30 may roll at different speeds, or may roll in different directions, thereby turning the main body 10 left or right. If the main body 10 meets an obstacle, the travelling direction of the main body 10 may be changed by the operation of the main wheels 30.

A dust collecting unit (or dust collector) 40 is removably mounted to the rear portion of the main body 10. If dirt is collected in the dust collecting unit 40, a user may remove the dust collecting unit 40 from the main body 10, and may eliminate the dirt from the dust collecting unit 40. A suction unit or component for generating suction force is provided in the main body 10. The suction unit includes a fan and/or motor, and the suction force is generated by the flow of air blown out by the fan and/or motor.

Figure 2:
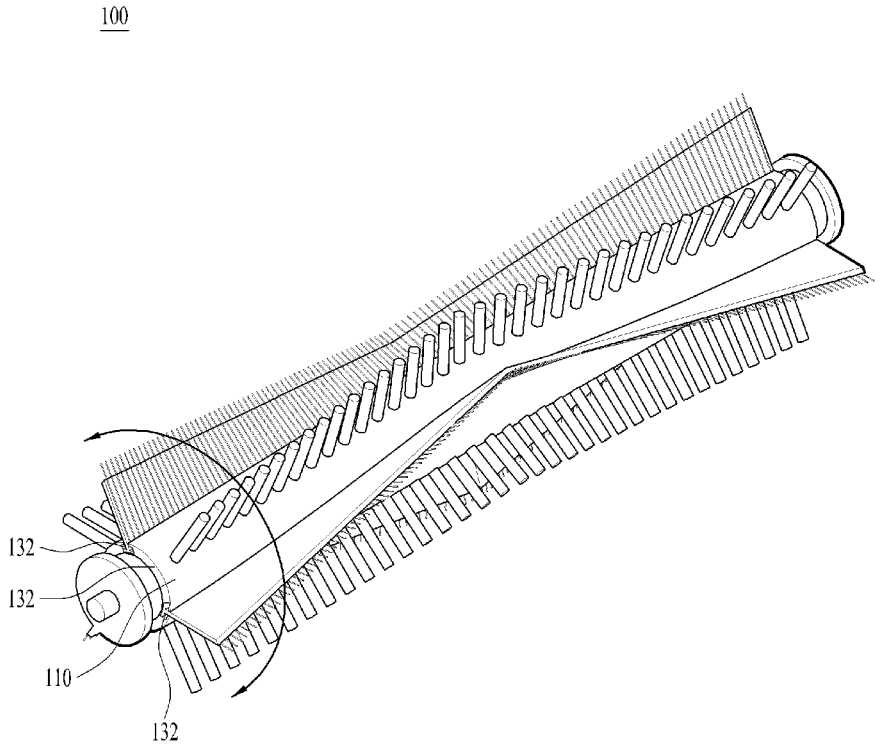
FIG. 2 is a view illustrating an agitator according to an embodiment.
Figure 3:
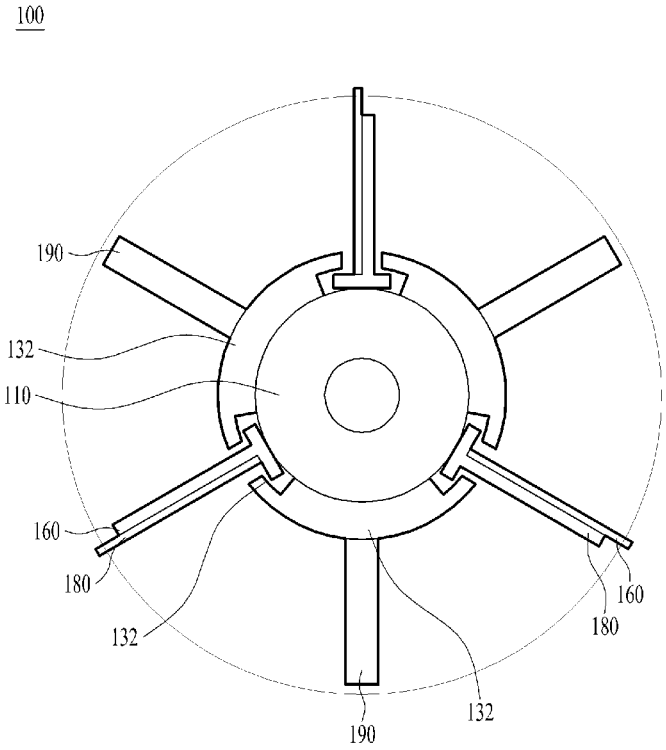
FIG. 3 is a sectional view of FIG. 2.
Figure 4:
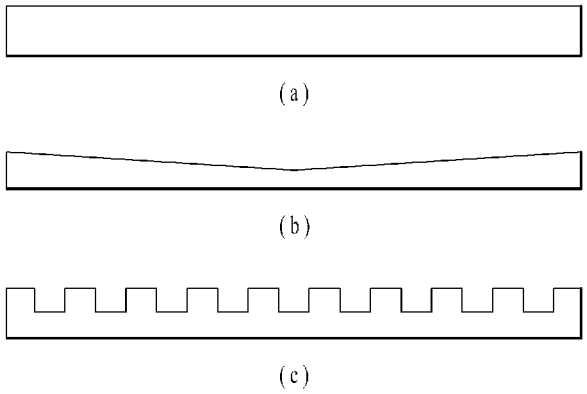
FIG. 4 is a view illustrating a blade.

FIG. 2 is a view illustrating an agitator according to an embodiment, FIG. 3 is a sectional view of FIG. 2, and FIG. 4 is a view illustrating a blade. Referring to FIGS. 2 and 3, an agitator 100 according to an embodiment includes a body 110 configured to be rotated, a plurality of coupling units (or couplers) 132 formed at the body 110 and arranged to be spaced apart from each other by a predetermined distance, and a first member (or first floor cleaner) 160 and a second member (or second floor cleaner) 180, which are coupled to any one of the coupling units 132 and are configured to contact the surface to be cleaned during the rotation of the body 110.

The coupling units 132 are arranged to be spaced apart from each other in the rotating direction along the circumference of the body 110. Members configured to sweep or strike the surface to be cleaned may be mounted to each of the coupling units 132. The members may be coupled to the coupling units 132 in a direction perpendicular to the rotation axis direction of the body 110.

The first member 160 and the second member 180 are coupled together to each of the coupling units 132. That is, the first member 160 and the second member 180 may be secured together to each of the coupling units 132.

As shown in FIG. 3, the first member 160 and the second member 180 may extend different lengths in the radial direction of the body 110. The difference in length between the first member 160 and the second member 180, which are coupled together to the same coupling unit 132, may create a difference in the area of contact between the first and second members 160 and 180 and the surface to be cleaned or a difference in the force applied to the surface to be cleaned.

The first member 160 and the second member 180 may be made of different materials. The first member 160 may be embodied as a blade made of a rubber material, and the second member 180 may be embodied as a brush having a plurality of bristles. The blade may be formed to be a rubber plate that extends longitudinally and has a predetermined area.

If either one of the first member 160 and the second member 180 is a brush having a plurality of bristles, the number of bristles of the brush may be decreased in order to reduce resistance to rotation of the brush, which is generated by friction with the surface to be cleaned. If either one of the first member 160 and the second member 180 is a blade made of a rubber material and the other one is a brush having bristles, the blade may function to prevent dirt, such as hair, fiber dust, etc., from being stuck to the bristles of the brush. Therefore, the agitator 100 may be kept clean.

The length of the blade, which extends from the body 110 in the radial direction, may be shorter than that of the brush. Because the blade includes a plane having a predetermined area, the blade may be more rigid than the brush having bristles. Therefore, the blade may support the brush so that the brush is not bent excessively. In other words, by mounting the blade and the brush to the same coupling unit 132, the number (or density) of bristles of the brush may be minimized, thereby reducing resistance to rotation, and the blade may prevent excessive bending of the brush.

On the other hand, the first member 160 and the second member 180 may not be mounted together to another coupling unit 132, but an additional member (or additional floor cleaner) 190 may be mounted to another coupling unit 132. In this embodiment, the members are arranged alternately in such a manner that the two members 160 and 180 are mounted to the same coupling unit 132 and the additional member 190 is mounted to another coupling unit 132, which is adjacent to the coupling unit 132 to which the two members 160 and 180 are mounted. The additional member 190 may be the same as one of the first member 160 and the second member 180. In other words, the additional member may be a brush or a blade.

The agitator may be provided with three different kinds of members, including the first member, the second member and the additional member. During the rotation of the agitator, the respective members come into contact with the surface to be cleaned with different friction and force. Therefore, the cleaning performance may be considerably enhanced.

FIGS. 4*a*, 4*b* and 4*c* are views illustrating blades having different shapes. The blade in FIG. 4*a* has a uniform height along the longitudinal direction thereof, and the blade in FIG. 4*b* has a height that varies along the longitudinal direction thereof. The blade in FIG. 4*c* has a plurality of concave portions, thereby reducing friction with the surface to be cleaned. When viewed from the front, the blade includes a plane, and thus has a different shape from the brush. Other various shapes of blades may also be applied to embodiments.

Figure 5:
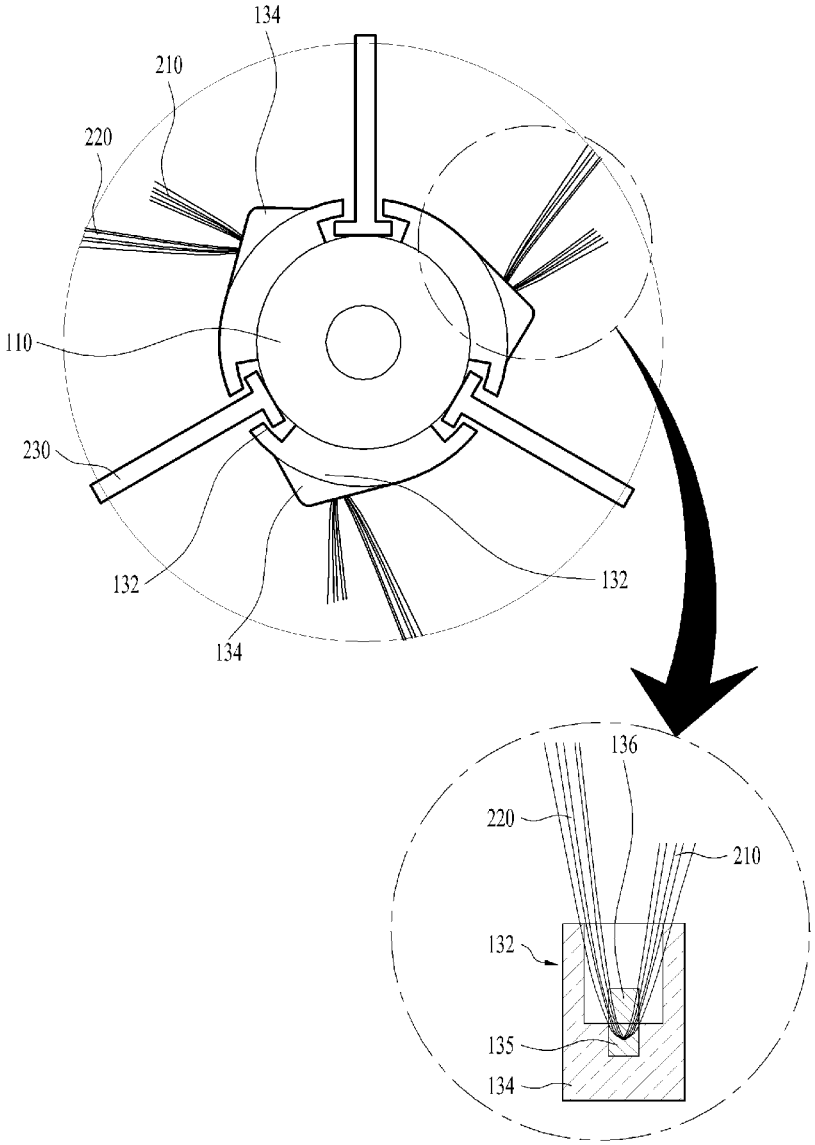
FIG. 5 is a view illustrating an agitator according to another embodiment.

FIG. 5 is a view illustrating an agitator according to another embodiment. The first member 210 and the second member 220 in this embodiment may be formed to have different lengths. The first member 210 and the second member 220 may be made of the same material, and may be embodied as brushes, each having a plurality of bristles.

Each of the coupling units 132 may include a recess 135, which is concavely formed in the body 110, and a fixing piece 136 for fixing the first member 210 and the second member 220 in the recess 135. The fixing piece (or a jam) 136 may be formed to have a pin shape so as to be pressed into the recess 135, thereby tightly fitting the first member 210 and the second member 220 in the recess 135.

Alternatively, the first member 210 and the second member 220 may be integrally formed using one or a group of bristles. Each bristle may be divided into two portions, which act respectively as the first member 210 and the second member 220. If the bristle is tightly fitted in the recess 135 by pressing the fixing piece 136 into the recess 135 in the state in which one divided portion of the bristle and the other divided portion of the bristle are unbalanced in length, the length of the first member 210 and the length of the second member 220 become different from each other. In order to make the lengths of the first member 210 and the second member 220 different from each other, it may also be possible for an assembly worker to cut off a portion of the first member 210 or a portion of the second member 220.

Each of the coupling units 132 may further include a protruding portion (or protrusions) 134 that protrudes from the body 110, and any one of the first member 210 and the second member 220 may extend obliquely with respect to the radial direction of the body 110.

When the first member 210 and the second member 220 are slanted at a predetermined angle with respect to the radial direction of the body 110, the area of contact between the first and second members 210 and 220 and the surface to be cleaned may be increased. Further, the first member 210 or the second member 220 may perform an operation of further smoothly sweeping the surface to be cleaned.

The circumference of the protruding portion 134 may extend in the tangential direction of the body 110, thereby securing an area for mounting the first member 210 and the second member 220. The first member 210 and the second member 220 may be mounted together to some of the coupling units 132, and an additional member 230 may be mounted to other coupling units 132. The additional member 230 may be embodied as a brush having bristles or a blade made of a rubber material.

Figure 6:
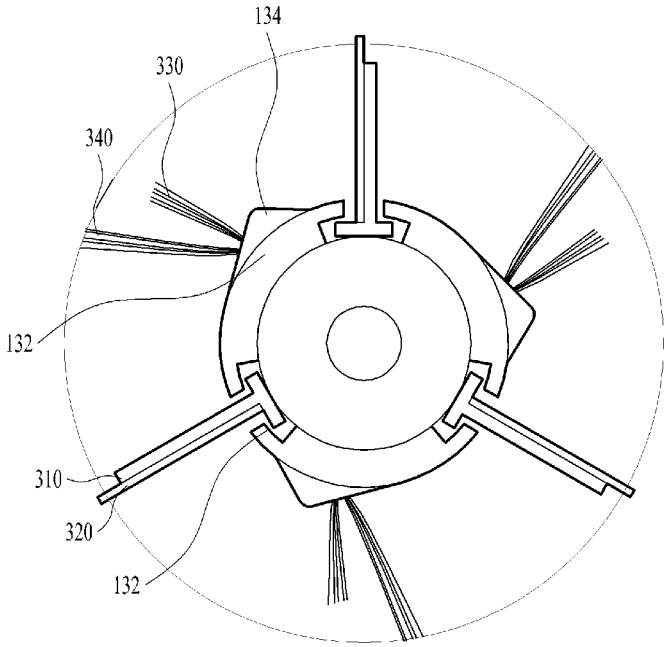
FIG. 6 is a view illustrating an agitator according to a further embodiment.
Figure 7:
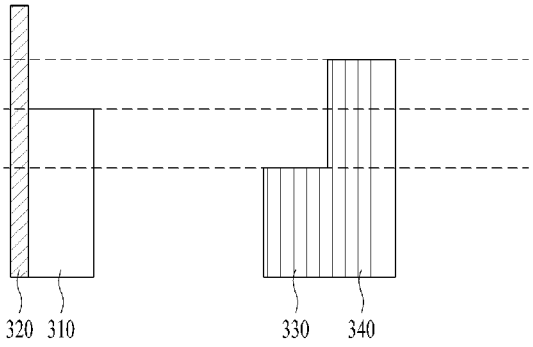
FIG. 7 is a view for explaining essential components in FIG. 6.

FIG. 6 is a view illustrating an agitator according to a further embodiment, and FIG. 7 is a view for explaining essential components in FIG. 6. An agitator according to this embodiment may include a body 110 configured to be rotated, a plurality of coupling units 132 formed to extend perpendicular to the rotating direction of the body 110 in the longitudinal direction, a first member 310 and a second member 320, which are coupled to any one of the coupling units 132 and are configured to contact the surface to be cleaned during rotation of the body 110, and a third member (or third floor cleaner) 330 and a fourth member (or fourth floor cleaner) 340, which are coupled to another one of the coupling units 132 and are configured to contact the surface to be cleaned during rotation of the body 110. In other words, different members may be coupled together to each of the coupling units 132.

As shown in FIG. 7, the first member 310, the second member 320, the third member 330 and the fourth member 340 may extend different lengths from the body 110 in the radial direction. Since the lengths of the first member 310, the second member 320, the third member 330 and the fourth member 340, which are provided at a single agitator to sweep or strike the surface to be cleaned through contact with the same, are all different from one another, superior cleaning performance for surfaces to be cleaned having various contours may be achieved.

In the case in which the cleaner equipped with the above-described agitator is a robot cleaner, it is hard for a user to replace the agitator with another one suitable for the cleaning environment. Accordingly, the agitator according to an embodiment is provided with various kinds of members that have excellent cleaning performance even in various cleaning environments.

The coupling unit 132 to which the first member 310 and the second member 320 are coupled and the coupling unit 132 to which the third member 330 and the fourth member 340 are coupled may be arranged alternately along the circumference of the body 110. This serves to reduce vibration and noise which may be generated because a variety of members are coupled to the agitator. At least one of the first member 310, the second member 320, the third member 330 and the fourth member 340 may be made of a different material.

In the robot cleaner equipped with the above-described agitator 100, the agitator 100 may be configured to be rotated independently of the rotation of the aforementioned wheels. Because the wheels are involved in travelling of the robot cleaner and the agitator 100 is involved in the cleaning operation of the robot cleaner, it is preferable that the wheels and the agitator 100 be operated independently of each other.

The agitator 100 may also be configured to be rotated while the suction unit generates suction force. Since the generation of suction force from the suction unit means that the robot cleaner is performing the cleaning operation, the agitator 100 is simultaneously rotated so as to sweep or strike the surface to be cleaned.

As is apparent from the above description, by mounting the blade and the brush to the same coupling unit, the number (or density) of bristles of the brush may be minimized, thereby reducing resistance to rotation, and the blade may prevent excessive bending of the brush. Accordingly, the agitator according to an embodiment may effectively remove fine dust as well as relatively large dirt.

Further, since the blade prevents dirt, such as hair, fiber dust, etc., from becoming stuck to the bristles of the brush, maintenance of the agitator becomes easy. Further, since the blade and the brush mounted to the same coupling unit come into contact with the surface to be cleaned, the performance with which fine dust, hair, etc. is removed may be enhanced.

Furthermore, two brushes mounted to the same coupling unit are configured to maintain a predetermined gap from the surface to be cleaned, thereby minimizing resistance to rotation and noise while facilitating the removal of relatively large pieces such as crumbs, etc. In addition, the brush mounted obliquely at a predetermined angle may compensate for any degradation in cleaning performance attributable to the multi-level structure.

An agitator and a robot cleaner of the present disclosure is capable of smoothly performing a cleaning operation in various environments. An agitator of the present disclosure is capable of exhibiting improved cleaning performance for the material of the surface to be cleaned while minimizing resistance to rotation, minimizing the adhesion of dirt to the agitator, and facilitating the removal of dirt after the agitator is used, and a robot cleaner including the agitator.

An agitator according to an embodiment of the present disclosure may include a body configured to be rotated, a plurality of coupling units arranged to be spaced apart from each other by a predetermined distance along the circumference of the body, and a first member and a second member coupled to any one of the coupling units and configured to contact the surface to be cleaned during the rotation of the body. While the body is rotated, the first member and the second member may come into contact with the surface to be cleaned, and may remove dirt from the surface to be cleaned by striking or scraping the surface to be cleaned.

The first member and the second member may extend different lengths from the body in a radial direction. Therefore, when the first member and the second member contact the surface to be cleaned, the intensity of the force with which the first member strikes or scrapes the surface to be cleaned may be different from that of the second member. Although the first member and the second member are rotated at the same rotation rate because they are coupled to a single body, the intensities of the rotating forces of the first and second members differ due to the difference in length.

The first member and the second member may be made of different materials from each other. Therefore, the intensity of the force with which the first member strikes or scrapes the surface to be cleaned may be different from that of the second member. Because different materials have different rigidities, the intensities of the forces applied to the surface to be cleaned differ from each other even though the first member and the second member are rotated at the same rotation rate.

The first member may be a blade made of a rubber material and including a plane having a predetermined area, and the second member may be a brush having a plurality of bristles. That is, the first member and the second member may have different shapes, and may be made of different materials from each other.

While the blade may include a plane having a predetermined area, a group of thin bristles may make up the overall shape of the brush. Because the area of the plane of the blade is larger than that of the group of bristles of the brush, the blade may be formed to be shorter than the brush. The length that the blade extends from the body in the radial direction may vary. Therefore, the shape of the portion of the blade that comes into contact with the surface to be cleaned may not be straight. The first member and the second member may be made of the same material, and may be brushes, each having a plurality of bristles.

Each of the coupling units may include a recess, concavely formed in the body, and a fixing piece for fixing the first member and the second member in the recess. The first member and the second member may be integrally formed using one or a group of bristles. In this case, an assembly worker may easily couple the brush to the body by fitting one or a group of bristles in the recess using the fixing piece.

Each of the coupling units may further include a protruding portion protruding from the body, and any one of the first member and the second member may extend obliquely with respect to the radial direction of the body. Since one of the first member and the second member is coupled to the body in a different direction from the other one, even though the first member and the second member are made of the same material or may have the same length, the intensities of the forces applied to the surface to be cleaned may be different from each other, thereby enhancing the cleaning performance.

According to another embodiment, an agitator includes a body configured to be rotated, a plurality of coupling units formed at the body and arranged to be spaced apart from each other by a predetermined distance, a first member and a second member coupled to any one of the coupling units and configured to contact the surface to be cleaned during the rotation of the body, and a third member and a fourth member coupled to another one of the coupling units and configured to contact the surface to be cleaned during the rotation of the body. The first member, the second member, the third member and the fourth member may extend different lengths from the body in a radial direction. Because the lengths of the members are all different, various cleaning effects may be achieved even with a single body when the members strike the surface to be cleaned due to the rotation of the body.

The coupling unit to which the first member and the second member are coupled and the coupling unit to which the third member and the fourth member are coupled may be arranged alternately along the circumference of the body, thereby preventing unbalanced rotation of the body. At least one of the first member, the second member, the third member and the fourth member may be made of a different material, so as to diversify the members. The members coupled to the same coupling unit may have different lengths from each other.

Any one of the first member, the second member, the third member and the fourth member may extend obliquely with respect to the radial direction of the body. Therefore, diverse cleaning effects may be achieved by coupling the members in different directions.

According to a further embodiment, a robot cleaner may include a main body defining an external appearance thereof, a suction unit provided at the main body, wheels for moving the main body, and an agitator provided at the main body, the agitator including a body configured to be rotated, a plurality of coupling units formed at the body and arranged to be spaced apart from each other by a predetermined distance, and a first member and a second member coupled to any one of the coupling units and configured to contact the surface to be cleaned during the rotation of the body. The first member and the second member may extend different lengths from the body in a radial direction.

The agitator may be configured to be rotated independently of rotation of the wheels. Even when the wheels are in a stationary state without being rotated, that is, when the robot cleaner is not moving, the cleaning operation may be performed.

The agitator may also be configured to be rotated while the suction unit generates suction force. Accordingly, if the agitator scrapes dirt off the surface to be cleaned, the suction unit may suck the dirt.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A robot cleaner comprising:

a main body;

a suction device provided in the main body;

wheels provided in the main body to move the robot cleaner; and an agitator provided in the main body, wherein the agitator includes:

a body configured to be rotated;

a plurality of couplers circumferentially arranged on an outer circumferential surface of the body and extending axially along the body;

a first floor cleaner and a second floor cleaner coupled to a first coupler of the couplers extending axially along the body and configured to contact a surface to be cleaned during rotation of the body, and a third floor cleaner and a fourth floor cleaner coupled to a second coupler of the couplers extending axially along the body and configured to contact the surface to be cleaned during rotation of the body, wherein the first floor cleaner and the second floor cleaner protrude different lengths from the body in a radial direction, wherein the third floor cleaner and the fourth floor cleaner protrude different lengths from the body in the radial direction, and wherein at least one of the first floor cleaner, the second floor cleaner, the third floor cleaner, or the fourth floor cleaner protrudes obliquely with respect to the radial direction of the body.

2. The robot cleaner according to claim 1, wherein all of the first floor cleaner, the second floor cleaner, the third floor cleaner, and the fourth floor cleaner have different lengths with respect to the radial direction of the body.

3. The robot cleaner according to claim 1, wherein the first floor cleaner is made of a differential material from the second floor cleaner.

4. The robot cleaner according to claim 1, wherein the first floor cleaner and the second floor cleaner are made of the same material.

5. The robot cleaner according to claim 1, wherein the first floor cleaner protrudes further from the body than the second floor cleaner in the radial direction.

6. The robot cleaner according to claim 1, wherein the first floor cleaner is an elastic blade extending from one end of body to an opposite end of the body, and the second floor cleaner is a brush having a plurality of bristles.

7. The robot cleaner according to claim 6, wherein the brush protrudes radially from the body further than the blade.

8. The robot cleaner according to claim 1, wherein at least one of the couplers includes a recess concavely formed in the body into which the first floor cleaner and the second floor cleaner are inserted, and a fixing piece for fixing the first floor cleaner and the second floor cleaner in the recess.

9. The robot cleaner according to claim 1, wherein at least one of the couplers includes a protruding portion protruding from the body, and at least one of the first floor cleaner or the second floor cleaner protrudes from the protruding portion obliquely with respect to the radial direction of the body.

10. The robot cleaner according to claim 1, wherein the first floor cleaner and the second floor cleaner are integrally formed using at least one group of bristles.

11. The robot cleaner according to claim 1, wherein the first coupler and the second coupler are arranged alternately along the outer circumferential surface of the body.

12. A robot cleaner comprising:

a main body;

a suction device provided in the main body;

wheels provided in the main body to move the robot cleaner; and an agitator provided in the main body, wherein the agitator includes:

a body configured to be rotated;

a plurality of couplers circumferentially arranged on an outer circumferential surface of the body and extending axially along the body;

a first floor cleaner and a second floor cleaner coupled to a first coupler of the plurality of couplers extending axially along the body and configured to contact a surface to be cleaned and strike the surface during rotation of the body, and an additional member coupled to a second coupler of the plurality of couplers extending axially along the body, wherein the first floor cleaner, the second floor cleaner, and the additional member are arranged alternately along the outer circumferential surface of the body, and wherein the first coupler includes a protruding portion protruding from the body and coupled to the first floor cleaner and the second floor cleaner, and at least one of the first floor cleaner or the second floor cleaner protrudes from the protruding portion obliquely with respect to a radial direction of the body.

13. The robot cleaner according to claim 12, wherein the second coupler includes a recess concavely formed in the body and coupled to a third floor cleaner and a fourth floor cleaner.

14. The robot cleaner according to claim 12, wherein the first coupler and the second coupler are arranged alternately along the outer circumferential surface of the body.

15. The robot cleaner according to claim 12, wherein the additional member includes:

a third floor cleaner and a fourth floor cleaner coupled to the second coupler and configured to contact the surface to be cleaned and to strike the surface during rotation of the body.

16. The robot cleaner according to claim 15, wherein at least one of the first floor cleaner, the second floor cleaner, the third floor cleaner, or the fourth floor cleaner is made of a different material.

17. The robot cleaner according to claim 16, wherein at least two of the first floor cleaner, the second floor cleaner, the third floor cleaner, or the fourth floor cleaner protrudes obliquely with respect to the radial direction of the body.

18. The robot cleaner according to claim 12, wherein the first floor cleaner is made of a differential material from the second floor cleaner.

19. The robot cleaner according to claim 12, wherein the first floor cleaner protrudes further from the body than the second floor cleaner in the radial direction.

* * * * *